US007884793B2

(12) United States Patent
Lee

(10) Patent No.: US 7,884,793 B2
(45) Date of Patent: Feb. 8, 2011

(54) LIQUID CRYSTAL DISPLAY AND METHOD OF MODIFYING GRAY SIGNALS FOR THE SAME

(75) Inventor: Baek-Woon Lee, Seongnam (KR)

(73) Assignee: Samsung Electronics Co., Ltd. (KR)

( * ) Notice: Subject to any disclaimer, the term of this patent is extended or adjusted under 35 U.S.C. 154(b) by 621 days.

(21) Appl. No.: 10/142,284

(22) Filed: May 9, 2002

(65) Prior Publication Data

US 2002/0180676 A1 Dec. 5, 2002

(30) Foreign Application Priority Data

May 11, 2001 (KR) ..... 2001-25816

(51) Int. Cl.
*G09G 3/36* (2006.01)

(52) U.S. Cl. ..... 345/98; 345/534

(58) Field of Classification Search ..... 345/539, 345/545–551, 87–104
See application file for complete search history.

(56) References Cited

U.S. PATENT DOCUMENTS 4,823,281 A * 4/1989 Evangelisti et al. ..... 345/561
5,457,481 A * 10/1995 Sohn et al. ..... 345/547
5,465,102 A * 11/1995 Usui et al. ..... 345/89
5,495,265 A 2/1996 Hartman et al.
6,115,092 A * 9/2000 Greene et al. ..... 349/74
6,515,672 B1 * 2/2003 Sheaffer et al. ..... 345/534
6,778,160 B2 * 8/2004 Kubota et al. ..... 345/89

FOREIGN PATENT DOCUMENTS

| | | |
|---|---|---|
| JP | 07056532 | 3/1995 |
| JP | 10039837 | 2/1998 |
| JP | 10187124 A * | 7/1998 |
| JP | 10276349 | 10/1998 |
| JP | 11126050 | 5/1999 |
| KR | 1020010050512 | 6/2001 |
| KR | 1020020010216 | 2/2002 |

* cited by examiner

*Primary Examiner*—Ke Xiao
(74) *Attorney, Agent, or Firm*—Cantor Colburn LLP

(57) ABSTRACT

A memory unit includes a buffer memory unit having first and second write buffer memories and first and second read buffer memories, and a frame memory section. The buffer memory unit is connected to the frame memory and a gray signal converter. The first and the second write buffer memories alternately store a sequence of data segments of current gray data from a signal source and alternately output the current data segments to the frame memory for storing. The first and the second read buffer memories read out a sequence of data segments of previous gray data from the frame memory and alternately output the previous data segments to the gray signal converter. The frame memory stores a plurality of previous and current data segments, and the total amount of the data segments stored in the frame memory is equal to or larger than those for one frame.

21 Claims, 6 Drawing Sheets

LIQUID CRYSTAL DISPLAY AND METHOD OF MODIFYING GRAY SIGNALS FOR THE SAME

BACKGROUND OF THE INVENTION (a) Field of the Invention

The present invention relates to a liquid crystal display and a method of modifying gray signals for the same, and more particularly to a liquid crystal display and a method for providing modified gray signals adapted for displaying motion pictures.

(b) Description of the Related Art

A typical liquid crystal display (LCD) includes a pair of panels and a liquid crystal layer with dielectric anisotropy, which is disposed between the two panels. The liquid crystal layer is applied with electric field, and the transmittance of light passing through the liquid crystal layer is adjusted by controlling the electric field, thereby obtaining desired images.

The LCD is the most commonly used one of flat panel displays (FPDs) handy to carry. Among the various types of LCDs, a thin film transistor liquid crystal display (TFT-LCD) employing the thin film transistors as switching elements is most widely used.

The TFT-LCD is used for a display of a television set as well as of a computer. Accordingly, it becomes increasingly important for the TFT-LCD to implement motion pictures. However, a conventional TFT-LCD has too slow response speed to implement motion pictures.

SUMMARY OF THE INVENTION

A liquid crystal display is provided, which includes: a liquid crystal panel assembly including a plurality of pixels; a gray signal modifier generating modified gray signals for gray signals from an external source, the modifier including a memory unit storing data segments of the gray signals and a gray signal converter converting the gray signals into the modified gray signals based on the data segments from the memory unit; and a data driver converting the modified gray signals into corresponding image signals to provide for the pixels.

According to an embodiment of the present invention, the memory unit includes: a frame memory storing data segments of a current gray signal and a previous gray signal; and a buffer memory unit storing and providing data segments of the current gray signal from the external source for the frame memory and storing and providing data segments of the previous gray signal from the frame memory for the converter.

Preferably, the modifier further includes a controller controlling operations of the buffer memory unit and the frame memory.

According to an embodiment of the present invention, the frame memory has a single input/output port.

Preferably, access speed to the frame memory is equal to or higher than transmission speed of the gray signals to the buffer memory unit and to the converter, and in particular, the access speed to the frame memory is preferably at least twice as high as the transmission speed of the gray signals to the buffer memory unit and to the converter.

According to an embodiment of the present invention, the access speed to the frame memory is $\alpha$ times faster than transmission speed of the gray signals to the buffer memory unit and to the converter, and $\alpha$ is given by $$\alpha = \frac{2m + FML + DQM + BML + \Delta}{m},$$

*or*

$$\alpha = \frac{2m + FML + DQM + BML + \Delta}{m + k \cdot \frac{m}{L}},$$

where m represents size of a data segment measured by clocks, FML represents the number of clocks for delay of the frame memory, BML represents the number of clocks for delay of the buffer memory unit, $\Delta$ represents the number of clocks required for movement of a data segment from the buffer memory unit to the frame memory, DQM represents the number of clocks required for masking between read-out and write-in operations of the frame memory in order to avoid I/O bus collision, k represents the number of clocks of blank section, and L represents the number of pixels in one pixel row.

According to an embodiment of the present invention, the buffer memory unit includes a first and second write buffer memories storing a first data segment of the current gray signal and providing a second data segment of the current gray signal stored therein for the frame memory, and first and second read buffer memories storing a first data segment of the previous gray signal from the frame memory and providing a second data segment stored therein for the converter.

According to an embodiment of the present invention, the buffer memory unit includes: a write buffer memory unit performing write-in operation for storing a first data segment of the current gray signal and performing read-out operation for reading a second data segment of the current gray signal stored therein to provide for the frame memory; and a read buffer memory unit performing write-in operation for storing a first data segment of the previous gray signal from the frame memory and performing read-out operation for reading a second data segment of the previous gray signal stored therein to provide for the converter.

According to an embodiment of the present invention, each of the write buffer memory unit and the read buffer memory unit includes a pair of buffer memories alternately performing read-out operation and write-in operation.

Alternatively, each of the write buffer memory unit and the read buffer memory unit includes a buffer memory simultaneously performing read-out operation and write-in operation. Preferably, the read-out operation of the write buffer memory unit is faster than the write-in operation of the write buffer memory unit, and the write-in operation of the read buffer memory unit is faster than the read-out operation of the read buffer memory unit.

According to an embodiment of the present invention, at least one of the write buffer memory unit and the read buffer memory unit is capable of storing a data segment, or capable of storing data larger than a data segment.

According to an embodiment of the present invention, the write-in operation of the write buffer memory unit begins prior to beginning of the read-operation of the write buffer memory unit.

According to an embodiment of the present invention, the write-in operation of the read buffer memory unit finishes prior to completion of the read-out operation of the read buffer memory unit.

According to an embodiment of the present invention, at least one of the write buffer memory unit and the read buffer memory unit includes a plurality of memory devices, each memory device having a single input/output port.

According to an embodiment of the present invention, the at least one of the write buffer memory unit and the read buffer memory unit is capable of storing data larger than a data segment, read-out operation and write-in operation of the at least one of the write buffer memory unit and the read buffer memory unit begin or finish separated by a distance corresponding to storage capacity of one of the memory devices.

According to an embodiment of the present invention, the write buffer memory unit includes a plurality of memory devices, each memory device having a single input/output port, and is capable of storing data larger than a data segment, and, wherein, when later one of the read-out operation and the write-in operation of the write buffer memory unit begins, earlier operation is performing one of the plurality of memory devices different from a first memory device where the later operation begins, and when the read-out operation moves to a second memory device, the read-out operation and the write-in operation of the write buffer memory unit are performing separated by a distance corresponding to storage capacity of one of the plurality of memory devices.

According to an embodiment of the present invention, the read buffer memory unit includes a plurality of memory devices, each memory device having a single input/output port, and is capable of storing data larger than a data segment, and, wherein, when earlier one of the read-out operation and the write-in operation of the write buffer memory unit finishes, later operation is performing one of the plurality of memory devices different from a memory device where the earlier operation finishes, and when the write-in operation moves to a final second memory device, the read-out operation and the write-in operation of the read buffer memory unit are performing separated by a distance corresponding to storage capacity of one of the plurality of memory devices.

According to an embodiment of the present invention, the modifier further includes: a signal synthesizer synthesizing the gray signals to provide for the memory unit and the converter; and a signal separator separating the modified gray signals from the converter. The signal synthesizer preferably divides each gray signal from the external source into a plurality of data segments.

A method of modifying gray signals for a liquid crystal display having a plurality of pixels is also provided. The method includes: dividing gray signals into a plurality of data segments; storing the data segments; and modifying a current gray signal based on the stored data segments.

According to an embodiment of the present invention, the storing includes: writing the data segments into a buffer memory; reading the data segments from the buffer memory to write into a frame memory; reading the data segments from the frame memory to write into the buffer memory; and reading out the data segments from the buffer memory.

According to an embodiment of the present invention, the storing includes: writing a first data segment into a buffer memory unit; reading a second data segment from the buffer memory unit to write into a frame memory; reading a third data segment from the frame memory to write into the buffer memory unit; and reading a fourth data segment from the buffer memory.

According to an embodiment of the present invention, the writing of the first data segment and the reading of the fourth data segment is simultaneously performed, and the reading of the second data segment and the reading of the third data segment is alternately performed during the writing of the first data segment and the reading of the fourth data segment.

Preferably, the first data segment and the second data segment are data segments of a current gray signal, and the third data segment and the fourth data segment are data segments of a previous gray signal.

Preferably, the writing and the reading for the frame memory are faster than the writing of the first data segment and the reading of the fourth data segment for the buffer memory unit.

According to an embodiment of the present invention, the buffer memory unit includes four buffer memories, and the first to the fourth data segments are written into and read out of the respective buffer memories.

According to another embodiment of the present invention, the buffer memory unit includes a pair of buffer memories, and the first data segment is written into and the second data segment is read out of one of the pair of buffer memories while the third data segment is written into and the fourth data segment is read out of the other of the pair of buffer memories. Preferably, the first data segment begins to be written into the one of the pair of buffer memories before the second data segment begins to be read out of the one of the pair of buffer memories. It is preferable that the third data segment finishes to be written into the other of the pair of buffer memories before the fourth data segment finishes to be read out of the other of the pair of buffer memories.

BRIEF DESCRIPTION OF THE DRAWINGS

The above and other objects and advantages of the present invention will become more apparent by describing in detail preferred embodiments thereof with reference to the accompanying drawings in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout. Then, liquid crystal displays and methods of modifying gray signals for the same according to embodiments of the present invention will be described with reference to the drawings.

Figure 1:
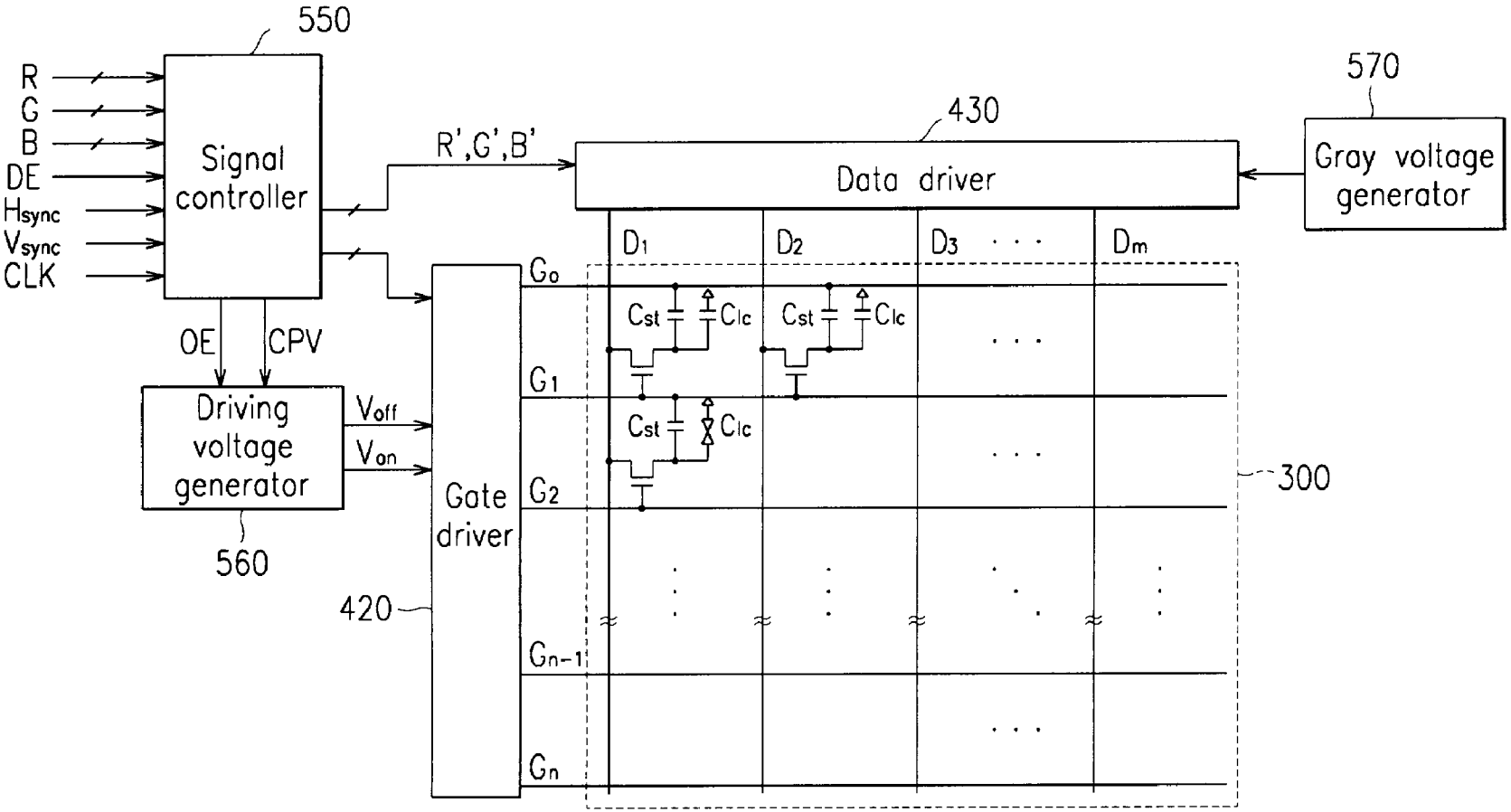
FIG. 1 is a block diagram of an LCD according to an embodiment of the present invention.
Figure 2:
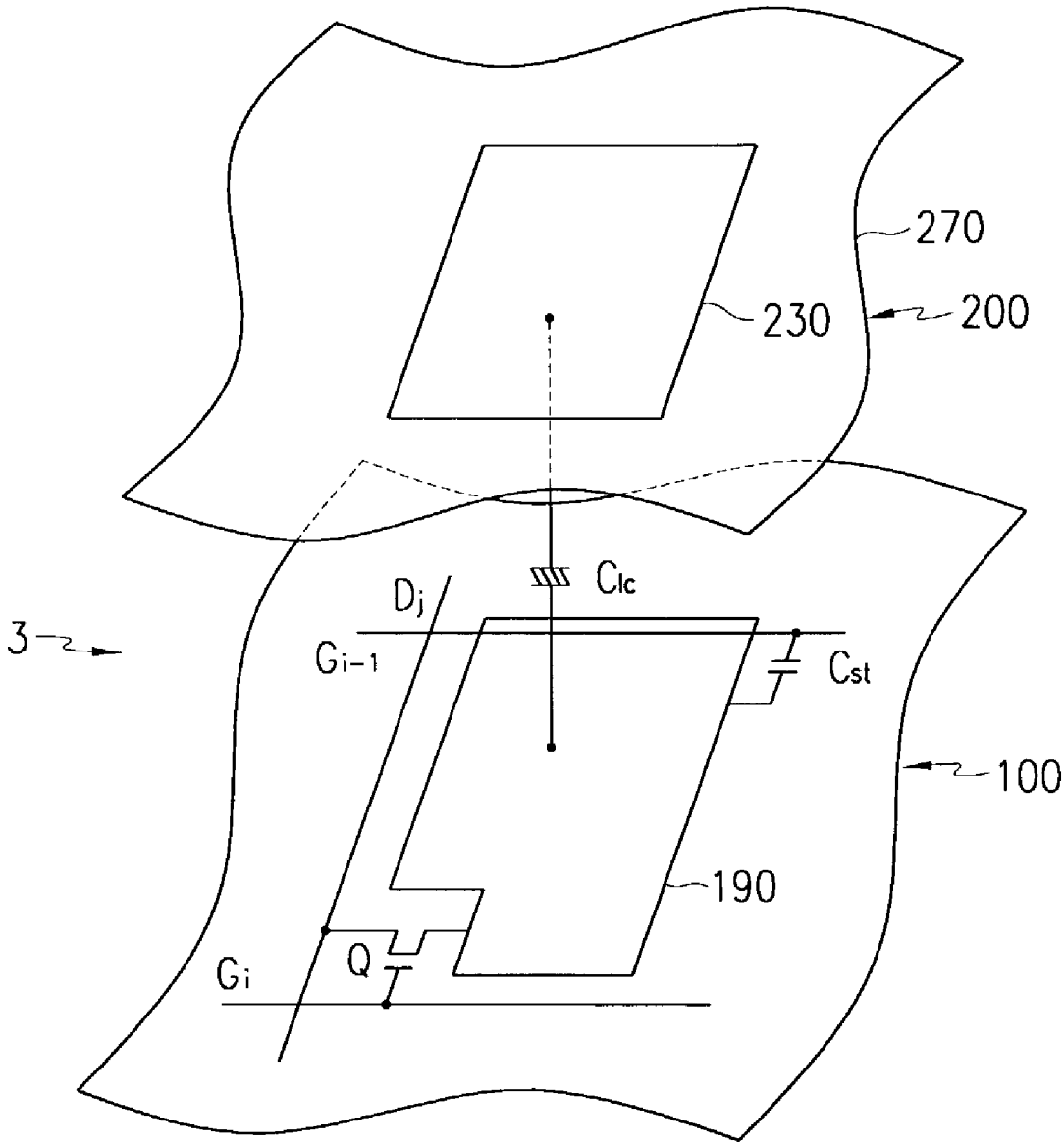
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a liquid crystal panel assembly 300, a gate driver 420 and a data driver 430 which are connected to the panel assembly 300, a driving voltage generator 560 connected to the gate driver 420, a gray voltage generator connected to the data driver 430, and a signal controller controlling the above elements.

In view of an equivalent circuit, the panel assembly 300 includes a plurality of signal lines $G_0$-$G_n$ and $D_1$-$D_m$ and a plurality of pixels. Each pixel includes a switching element Q, and a liquid crystal capacitor $C_{1c}$ and a storage capacitor $C_{st}$ that are connected to the switching element Q. The signal lines $G_0$-$G_n$ and $D_1$-$D_m$ includes a plurality of scanning lines or gate lines $G_0$-$G_n$ extending in a row direction and transmitting scanning signals or gate signals, and a plurality of data lines $D_1$-$D_m$ extending in a column direction and transmitting image signals or data signals.

The switching element Q has three terminals, a control terminal connected to one of the gate lines $G_0$-$G_n$, an input terminal connected to one of the data lines $D_1$-$D_m$ and an output terminal connected to both the liquid crystal capacitor $C_{1c}$ and the storage capacitor $C_{st}$. The liquid crystal capacitor $C_{1c}$ is connected between the output terminal of the switching element Q and a reference voltage or a common voltage $V_{com}$. The storage capacitor $C_{st}$ is connected between the output terminal of the switching element Q and a previous gate line located just above. Alternatively, the storage capacitor $C_{st}$ may be connected to a predetermined voltage such as the reference voltage $V_{com}$. The former type of connection of the storage capacitor $C_{st}$ is called a previous gate type, while the latter called a separate wire type.

FIG. 2 schematically shows the structure of a panel assembly according to an embodiment of the present invention. For easy explanation, only a pixel is illustrated in FIG. 2.

As shown in FIG. 2, a panel assembly 300 includes a lower panel 100, an upper panel 200 opposite the lower panel 100 and a liquid crystal layer 3 interposed therebetween. A pair of gate lines $G_i$, and $G_{i-1}$, a data line $D_J$, a switching element Q and a storage capacitor $C_{st}$ are provided on the lower panel 100. A pixel electrode 190 on the lower panel 100 and a reference electrode 270 on the upper panel 200 form two terminals of a liquid crystal capacitor $C_{1c}$. The liquid crystal layer 3 disposed between the two electrodes 190 and 270 functions as dielectric of the liquid crystal capacitor $C_{1c}$.

The pixel electrode 190 is connected to the switching element Q and the reference electrode 270 is connected to the common voltage and covers entire surface of the upper panel 200. The orientations of liquid crystal molecules in the liquid crystal layer 3 is changed by the change of electric field generated by the pixel electrode 190 and the reference electrode 270. The change of the molecular orientations changes the polarization of light passing through the liquid crystal layer 3, which in turn causes the variation of the transmittance of the light by a polarizer or polarizers (not shown) attached to at least one of the panels 100 and 200.

The pixel electrode 190 overlaps its previous gate line $G_{i-1}$ via an insulator to form one terminal of a storage capacitor $C_{st}$, while the previous gate line $G_{i-1}$ forms the other terminal thereof. For the separate wire type, a separate wire (not shown) provided on the lower panel 100 overlaps the pixel electrode 190 to form a storage capacitor $C_{st}$.

FIG. 2 shows a MOS transistor as a switching element, and the MOS transistor is implemented as a thin film transistor (TFT) having an amorphous silicon or polysilicon channel layer in practical manufacturing process.

Although the reference electrode 270 shown in FIG. 2 is provided on the upper panel 200, it can be provided on the lower panel 100. In this case, both the electrodes 190 and 270 have shapes of stripes.

For realizing color display, each pixel can represent a color by providing a plurality of red, green and blue color filters 230 in an area corresponding to the pixel electrode 190. The color filter 230 shown in FIG. 2 is provided in the corresponding area of the upper panel 200. Alternatively, the color filter 230 is provided on or under the pixel electrode 190.

Referring FIG. 1 again, the gate driver 420 and the data driver 430, which are often called a scanning driver and a source driver, respectively, may include a plurality of gate driving ICs (integrated circuits) and a plurality of data driving ICs, respectively. The ICs may be separately placed external to the panel assembly 300 or mounted on the panel assembly 300. Alternatively, the ICs may be formed on the panel assembly 300 by the same process as the signal lines $G_0$-$G_n$ and $D_1$-$D_m$ and the thin film transistors Q.

The gate driver 420 is connected to the gate lines $G_0$-$G_n$ of the panel assembly 300 and applies gate signals from the driving voltage generator 560 to the gate lines $G_0$-$G_n$, each gate signal being a combination of a gate-on voltage $V_{on}$ and a gate off voltage $V_{off}$. The data driver 430 is connected to the data lines $D_1$-$D_n$ of the panel assembly 300 and selects gray voltages from the gray voltage generator to apply as data signals to the data lines $D_1$-$D_n$.

The gate driver 420, the data driver 430 and the driving voltage generator 560 are controlled by the signal controller 400 connected thereto and located external to the panel assembly 300. The operation will be described in detail.

The signal controller 550 is supplied from an external graphic controller (not shown) with RGB gray signals R, G and B and control input signals controlling the display thereof, for example, a vertical synchronizing signal $V_{sync}$, a horizontal synchronizing signal $H_{sync}$, a main clock CLK, a data enable signal DE, etc. After generating gate control signals and data control signals on the basis of the control input signals and processing the gray signals suitable for the operation of the panel assembly 300, the signal controller 550 provides the gate control signals to the gate driver 420, and the processed gray signals R', G' and B' and the data control signals to the data driver 430. The process of the gray signals will be described later in detail.

The gate control signals include a vertical synchronizing start signal STV for instructing to begin outputting gate-on pulses (high sections of the gate signals), a gate clock signal CPV for controlling the output period of the gate-on pulses and a gate-on enable signal OE for defining the widths of the gate-on pulses. Among the gate control signals, the gate-on enable signal OE and the gate clock signal CPV are provided for the driving voltage generator 560. The data control signals include a horizontal synchronizing start signal STH for instructing to begin outputting the gray signals, a load signal LOAD or TP for instructing to apply the appropriate data voltages to the data lines, and a data clock signal HCLK.

Responsive to the gate control signals, the gate driver 420 sequentially applies the gate-on pulses to the gate lines $G_0$-$G_n$, thereby sequentially turning on the switching elements Q connected thereto. In response to the data control signals, the data driver 430 converts the entering gray signals R', G' and B' into analog voltages from the gray voltage generator 570 and supplies the analogue voltages to the corresponding data lines $D_1$-$D_m$ as image signals. Then, the image signals in turn are applied to the corresponding pixels via the turned-on switching elements Q. By performing this procedure, all gate lines G0-Gn are supplied with the gate pulses during a frame, thereby applying all pixel rows with image data.

The processing of the gray signals by the signal controller 550 according an embodiment of the present invention is intended to generate a modified gray signal based on both a gray signal of a current frame (hereinafter referred to as "current gray signal") and a gray signal of a previous frame (hereinafter referred to as "previous gray signal"). Such modifications of gray signals suggested by the inventor are disclosed in U.S. patent application Ser. No. 09/773,603 filed on Feb. 2, 2001, Korean Patent Application Nos. 10-2000-0005442 filed on Feb. 3, 2000 and 10-2000-0073672 filed on Dec. 6, 2000, EP Patent Application No. 01102227.4 filed on Jan. 31, 2001, Chinese Patent Application No. 01111679.X filed on Feb. 3, 2001, Japanese Patent Application No. 2001-28541 filed on Feb. 5, 2001 and Taiwanese Patent Application Nos. 89123095 filed on Nov. 2, 2000 and 90101788 filed on Jan. 30, 2001, which are incorporated herein by reference.

The modification of the gray signals according to an embodiment of the present invention will be described in detail with reference to FIG. 3.

Figure 3:
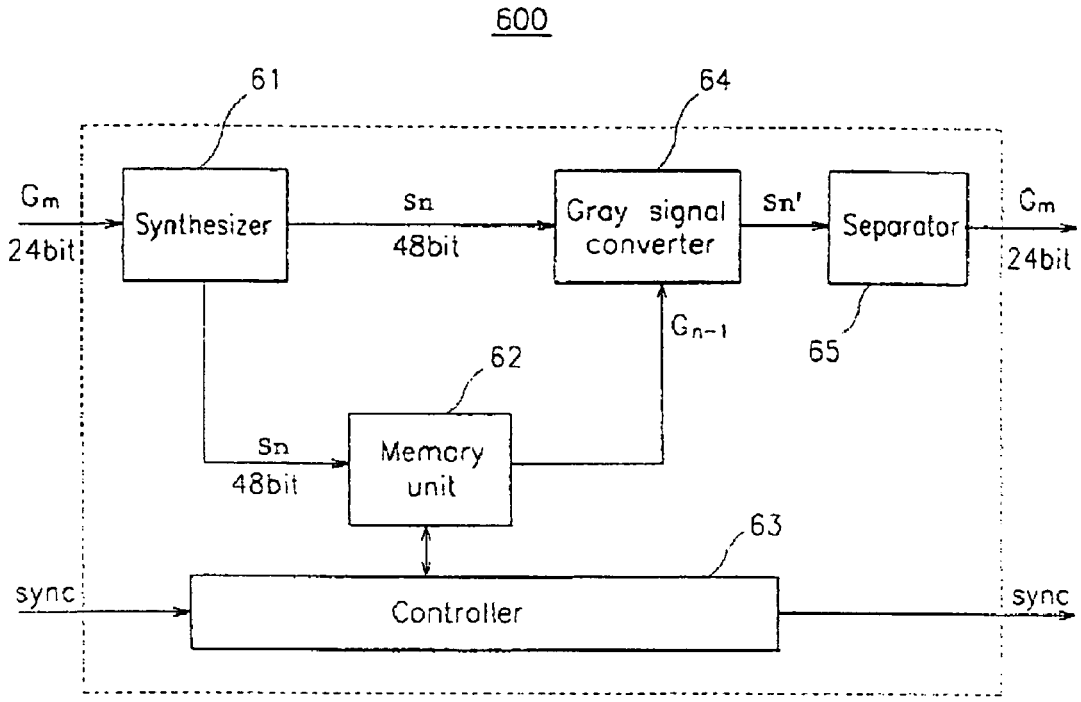
FIG. 3 shows a gray signal modifier of an LCD according to an embodiment of the present invention.

FIG. 3 shows a block diagram of a gray signal modifier according to an embodiment of the present invention. The signal modifier may be incorporated with the signal controller or independently implemented to be separated from the signal controller.

As shown in FIG. 3, the gray signal modifier 600 includes a signal synthesizer 61, a memory unit 62 including such as a frame memory connected to the synthesizer 61, a controller 63 connected to the memory unit 62, a gray signal converter 64 and a signal separator 65.

Upon receiving a gray signal or a gray data from a signal source (not shown), the synthesizer 61 of the gray signal modifier 600 converts the frequency of the gray data stream so that the gray signal $G_m$ be processed by the gray signal modifier 600, for example, so that the gray data stream is in synchronization with an access clock for the memory unit 62. For example, if 24-bit gray data from the signal source are supplied with 65 MHz and the maximum processing frequency of the components of the gray signal modifier 600 is 500 MHz, the synthesizer 61, synthesizes every two 24-bit gray signals $G_m$ into one 48-bit gray signal $S_n$. The synthesizer 61 provides the synthesized gray signal $S_n$ as a current gray signal for the memory unit 62 and the gray signal converter 64.

The controller 63 provides a previous gray signal $G_{m-1}$ stored in the memory unit 62 for the gray signal converter 64 and stores the current gray signal $G_m$ in the memory unit 62.

The gray signal converter 64 generates modified gray signal $S_n'$ based on the current gray signal $S_n$ from the synthesizer 61 and the previous gray signal $G_{m-1}$ from the memory unit 62 to provide for the separator 65.

The separator 65 separates the modified 48-bit gray signal $S_n'$ into and outputs modified 24-bit gray signal $S_n'$.

In this embodiment of the present invention, the synthesizer 61 and the separator 65 are used since the clock frequency associated with the transmission of the gray signals is different from the clock frequency for processing the gray signals in the gray signal modifier 600, for example, the clock frequency for accessing the memory unit 62. However, when the two frequencies are equal to each other, the synthesizer 61 and the separator 65 are not required.

A lookup table may be used for modifying the gray signals $S_n'$ which is in a read only memory (ROM) to be accessed by the gray signal converter 64. Alternatively, a digital circuit for calculating the gray signals $S_n'$ may be used.

As described above, the memory unit 62 concurrently performs the write-in operation on the current gray signals $S_n$ and the read-out operation on the previous gray signal $S_{n-1}$ to output to the gray signal converter 64. However, when using a frame memory including a DRAM (dynamic random access memory) with a single input/output port as the memory unit 62, the write-in operation and the read-out operation of the memory unit 62 cannot be simultaneously performed. Accordingly, a pair of frame memories for respectively performing the read-out operation and the write-in operation in a frame and changing their roles frame by frame are utilized. However, since the frame memory is expensive, the embodiments of the present invention adapt one frame memory and a plurality of buffer memories instead of using two frame memories.

According to an embodiment of the present invention, a gray signal or a gray data of each frame is divided into several data segments, and sequentially modifies the segments segment by segment. The segments are sequentially stored in the memory unit 62.

Figure 4A:
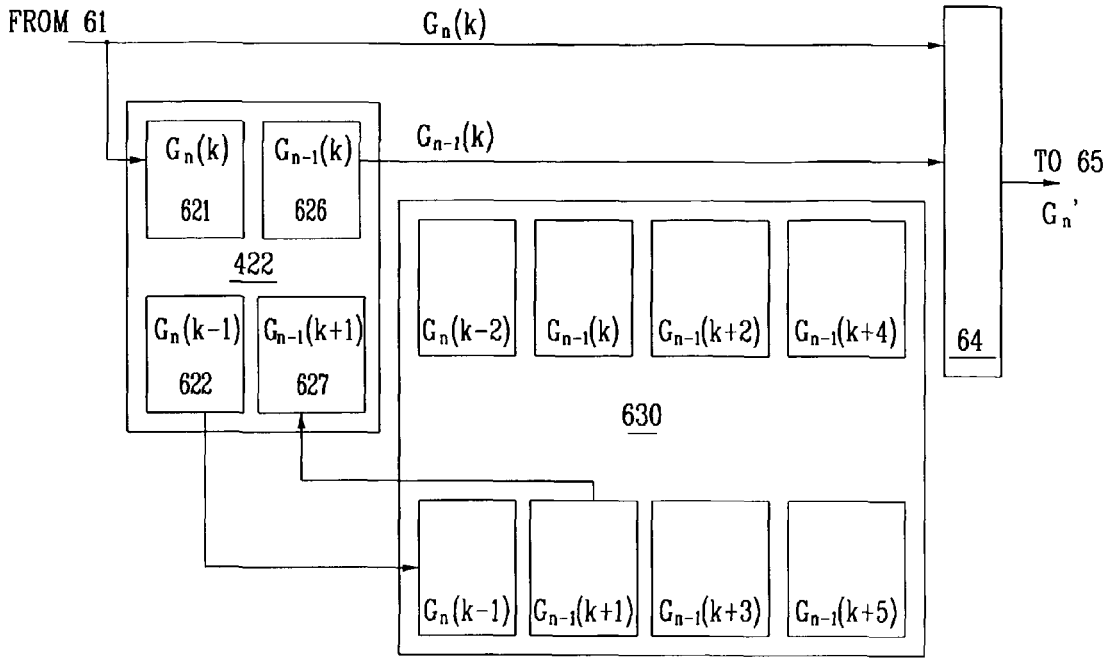
FIGS. 4A and 4B show a memory unit of an LCD according to the preferred embodiment of the present invention.
Figure 4B:
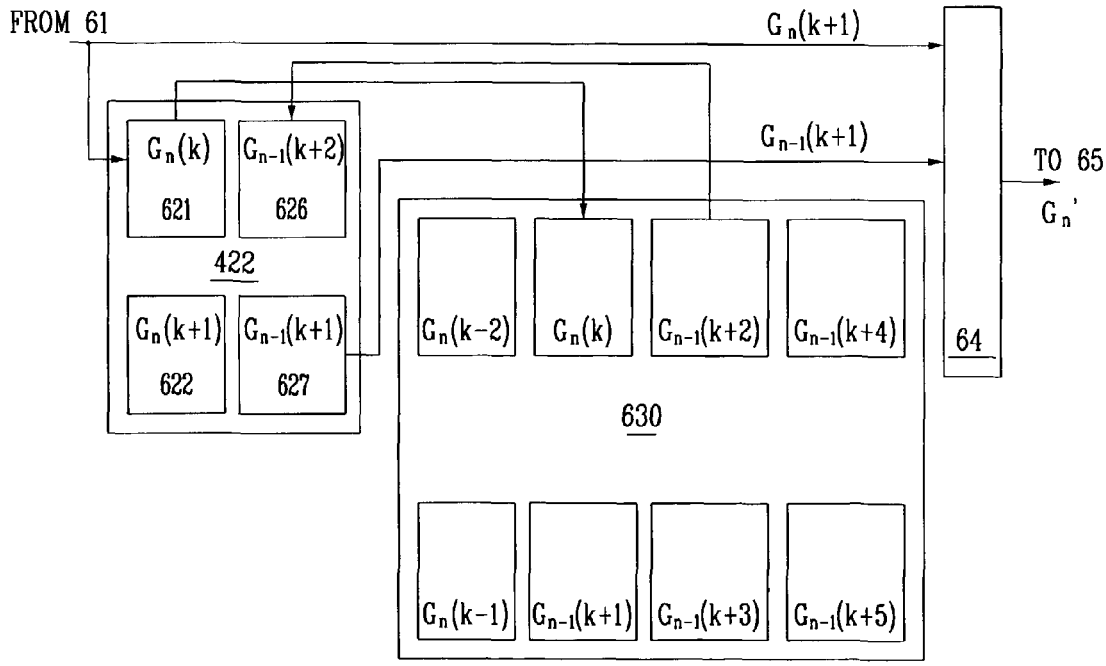

Referring to FIGS. 4A and 4B, a memory unit and the operation thereof according, to an embodiment of the present invention will be described in detail.

As shown in FIGS. 4A and 4B, a memory unit 62 according to another embodiment of the present invention includes a buffer memory unit 620 having first and second write buffer memories 621 and 622 and first and second read buffer memories 626 and 627, and a frame memory section 630. The buffer memory unit 620 is connected to the frame memory 630 and a gray signal converter 65.

According this embodiment, the first and the second write buffer memories 621 and 622 alternately store a sequence of data segments of current gray data from a signal source and alternately output the current data segments to the frame memory 630 for storing. The first and the second read buffer memories 626 and 627 read out a sequence of data segments of previous gray data from the frame memory 630 and alternately output the previous data segments to the gray signal converter 64. The frame memory 630 stores a plurality of previous and current data segments, and the total amount of the data segments stored in the frame memory 630 is equal to or larger than those for one frame.

A method for controlling the memory unit shown in FIGS. 4A and 4B will now be described in detail.

First, gray data for each frame are broken into several data segments. One data segment is preferably a set of data to be applied with sequential pixels. This segmentation can be made by the synthesizer 61 shown in FIG. 3 or in synchronization with the capacity of one write buffer memory. The data segments are provided for both the gray signal converter 64 and the buffer memory unit 620.

Referring to FIG. 4A, the k-th data segment $G_n(k)$ of the current gray data is written in the first write buffer memory 621, and at the same time, the k-th data segment $G_{n-1}(k)$ of the previous gray data stored in the first read buffer memory 626 is read out and supplied to the gray signal converter 64. Within this time, the (k−1)-th data segment $G_n(k-1)$ of the current gray data stored in the second write buffer memory 622 is read out and written in the frame memory 630, and thereafter, the (k+1)-th data segment $G_{n-1}(k+1)$ of the previous gray data is read out of the frame memory 630 and written in the second read buffer memory 627.

Referring to FIG. 4B, the next data segment, i.e., the (k+1)-th data segment $G_n(k+1)$ of the current gray data from the synthesizer 61 is written in the second write buffer memory 622, and the k-th data segment $G_{n-1}(k)$ of the previous gray data stored in the second read buffer memory 627 is read out and output to the gray signal converter 64. The k-th data segment $G_n(k)$ of the current gray data stored in the first write buffer memory 621 is written in the frame memory 630, and then the (k+2)-th data segment $G_{n-1}(k+2)$ of the previous gray data is read out of the frame memory 630 and written in the first read buffer memory 626.

Although the frame memory 630 of this embodiment performs the write-in operation before performing the read-out operation, the sequence of the write-in operation and the read-out operation may be altered.

In this embodiment, since a data segment stored in the buffer memory unit 620 is written in the frame memory 630 and another data segment stored in the frame memory 630 is read out of the frame memory 630 while a data segment is entering the buffer memory unit 620, the read and write speeds of the frame memory are preferably higher than that the entering speed of the data segment into the buffer memory unit 620.

It is assumed that the read and the write speed of the frame memory is α times compared with the entering speed of a data segment into the buffer memory unit 620. α is determined as follows:

$$\alpha = \frac{2m + FML + DQM + BML + \Delta}{m},$$

where m represents the size of the data segment measured by clocks (or the capacity of a buffer memory), FML (frame memory latency) represents the number of clocks for delay of the frame memory 630 (for example, two or three clocks), BML (buffer memory latency) represents the number of clocks for delay of the buffer memory 620 (for example, one or two clocks), Δ represents the number of clocks required for the movement of the data segment from the buffer memory 630 to the frame memory 620, and DQM represents the number of clocks required for masking between the read-out and the write-in operations of the frame memory 630 in order to avoid I/O bus collision (for example, one clock. It can be seen that α is larger than two.

Considering a blank section between the data for two pixel rows, $$\alpha = \frac{2m + FML + DQM + BML + \Delta}{m + k \cdot \frac{m}{L}},$$

where k represents the number of clocks of the blank section, and L represents the number of pixels in one pixel row. It can be seen that α can be less than 2 if m is quite large.

The embodiment shown in FIGS. 4A and 4B uses four buffer memories including two write buffer memories 621 and 622 and two read buffer memories 626 and 627. However, subsequent embodiments suggest using only two buffer memories, one for reading and the other for writing. In these embodiments, a current data segment of a current gray signal is written in and a previous data segment of the current gray signal is read out of one single write buffer memory, and a next data segment of a previous gray signal is written in and a current data segment of the previous gray signal is read out of one single read buffer memory.

FIGS. 5A, 5B, 6A and 6B show write buffer memories simultaneously performing read and write operations according to embodiments of the present invention. Each buffer memory includes a plurality of storage regions called memory cells, each cell storing data for one pixel, and a data segment contains data for m pixels.

Figure 5A:
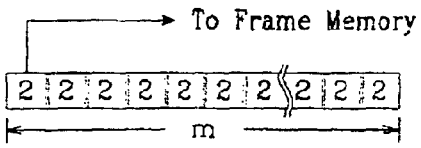
FIGS. 5A to 9B show buffer memories of an LCD according to the preferred embodiment of the present invention.
Figure 5B:
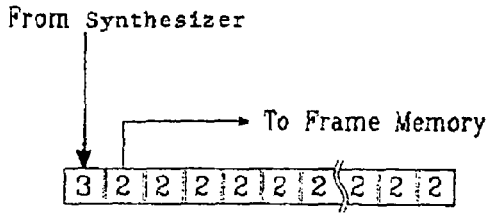

A write buffer memory shown in FIGS. 5A and 5B includes m cells so that it stores data for only one data segment. As shown in FIGS. 5A and 5B, the read-out operation of the buffer memory begins before starting the write-in operation. The data read out of the buffer memory are provided for a frame memory. After preferably one or more memory cells are read out to become empty as shown in FIG. 5A, the write-in operation for the next data segment from a synthesizer begins as shown in FIG. 5B. After completion of the read-out and the write-in operations, the data segment stored in the buffer memory is substituted with the next data segment.

Figure 6A:
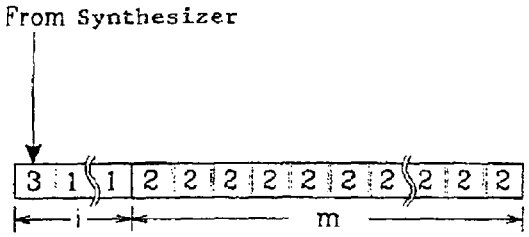
Figure 6B:
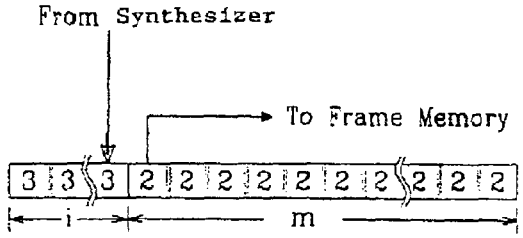

A write buffer memory shown in FIGS. 6A and 6B has (m+i) memory cells so that it stores data larger than one data segment. The write-in operation can start before beginning the read-out operation as shown in FIG. 6A. The read-out operation starts before finishing the write-in operation on the first i cells as shown in FIG. 6B.

FIGS. 7A, 7B, 8A and 8B show read buffer memories simultaneously performing read and write operations according to embodiments of the present invention. Each buffer memory includes a plurality of memory cells, each cell storing data for one pixel, and a data segment contains data for m pixels.

Figure 7A:
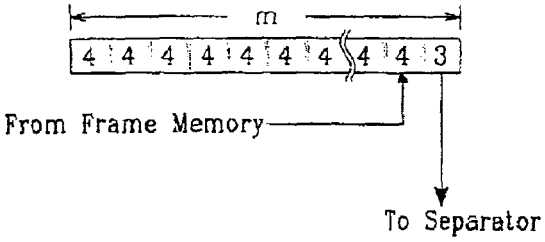
Figure 7B:
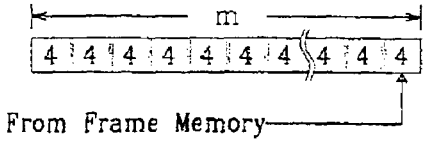

A read buffer memory shown in FIGS. 7A and 7B includes m cells so that it stores data for only one data segment, which has the same capacity as the write buffer memory shown in FIGS. 5A and 5B. The read-out operation of the read buffer memory starts before beginning the write-in operation. As shown in FIG. 7A, the read-out operation of the buffer memory for a data segment stored in the buffer memory to a separator finishes before completing the write-in operation for the next data segment from a frame memory. Before preferably one or more memory cells are remained unwritten, the read-out operation is completed as shown in FIG. 7A. After completion of the read-out and the write-in operations, the data segment stored in the buffer memory is substituted with the next data segment as shown in FIG. 7B.

Figure 8A:
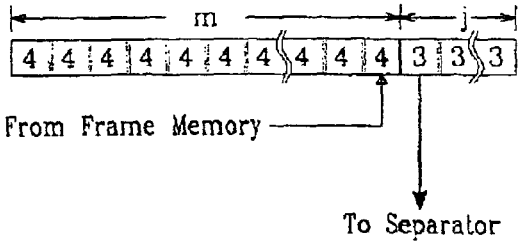
Figure 8B:
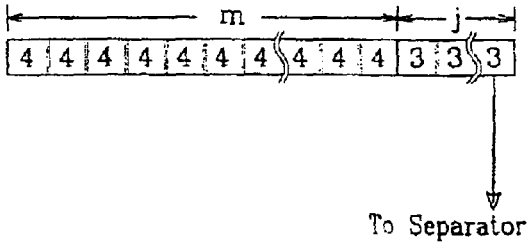

A read buffer memory shown in FIGS. 8A and 8B has (m+j) memory cells so that it stores data larger than one data segment as does the write buffer memory shown in FIGS. 6A and 6B. The read-out operation on the last j cells starts before completing the write-in operation as shown in FIG. 8A. The write-in operation may be completed before finishing the read-out operation as shown in FIG. 8B.

The above-described method can be used without any restrictions for a buffer memory including dual-port RAMs (random access memories). However, if some restrictions are required for a buffer memory including single-port RAMs, which cannot simultaneously perform read and write operations. That is, the read-out operation and the write-in operation should be performed on the different RAMs.

For example, it is assumed that each RAM forming the buffer memory stores data for h pixels.

For the buffer memories shown in FIGS. 5A, 5B, 7A and 7B, starting the read-out operation before starting the write-in operation, the distance between cells where the read and write operations are performing is maintained at least h cells every time. When the speed of the read-out operation is faster than that of the write-in operation as the write buffer memory shown in FIGS. 5A and 5B, it is sufficient to begin the write-in operation after finishing the read-out operation on the first h cells. On the contrary, when the speed of the read-out operation is slower than that of the write-in operation as the read buffer memory shown in FIGS. 7A and 7B, it is sufficient to complete the read-out operation before starting the write-in operation on the last h cells.

For the write buffer memory shown in FIGS. 6A and 6B, since the read-out operation is faster than the write-in operation, it is sufficient to satisfy the following conditions:

when later one of the read-out operation and the write-in operation begins, a RAM where the later one begins should not be under earlier operation; and when the read-out operation moves to a second RAM, the distance between cells where the read-out operation and the write-in operation are performing is equal to or larger than h cells.

On the contrary, for the buffer memories shown in FIGS. 8A and 8B, since the write-in operation is faster than the read-out operation, it is sufficient to satisfy the following conditions:

when earlier one of the read-out operation and the write-in operation finishes, a RAM where the earlier operation finishes should not be under later operation; and when the write-in operation moves to a final RAM, the distance between cells where the read-out operation and the write-in operation are performing is equal to or larger than h cells.

Figure 9A:
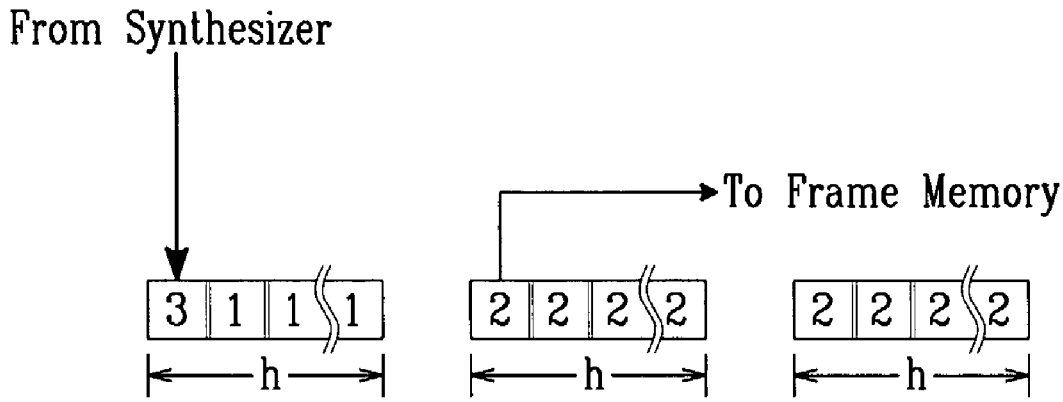
Figure 9B:
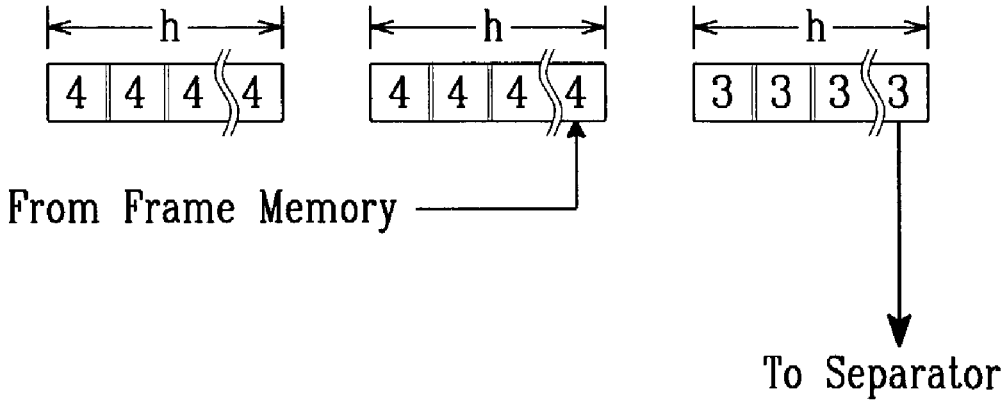

FIGS. 9A and 9B shows examples of write and read buffer memories having (m+h) cells, and thus one RAM of each buffer memory stores data of a data segment different from that stored in other RAMs. As shown in FIG. 9A, a first RAM contains data for a data segment previous to a previous data segment, and remaining RAMs contain data for the previous data segment. The write-in operation for a current data segment from a synthesizer begins at the first RAM, while the read-out operation for the previous data segment to a frame memory begins at a second RAM. As shown in FIG. 9B, the read-out operation for a current data segment to a separator finishes at a last RAM, while the write-in operation for a next data segment from a frame memory finishes at a RAM next to the last RAM.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a liquid crystal panel assembly including a plurality of pixels;

a gray signal modifier generating a modified gray signal; and a data driver converting the modified gray signal into corresponding image signals to provide for the pixels.

wherein the gray signal modifier comprises:

a frame memory storing data segments of a current gray signal and a previous gray signal;

a buffer memory unit receiving data segments of the current gray signal from an external source, providing the data segments of the current gray signal for the frame memory, and receiving and storing the data segments of the previous gray signal stored in the frame memory; and a gray signal converter converting all of the data segments of the current gray signal from an external source into the modified gray signal based on the data segments of the previous gray signal stored in the buffer memory, the data segments of current gray signal, and a lookup table, wherein the data segments of the current gray signal are converted into the modified gray signal to improve the response speed of liquid crystal molecules in the liquid crystal panel assembly, and wherein the buffer memory unit comprises:

a write buffer memory unit performing write-in operation for storing a first data segment of the current gray signal and performing read-out operation for reading a second data segment of the current gray signal stored therein to provide for the frame memory; and a read buffer memory unit performing write-in operation for storing a first data segment of the previous gray signal from the frame memory and performing read-out operation for reading a second data segment of the previous gray signal stored therein to provide for the converter, and wherein each of the write buffer memory unit and the read buffer memory unit comprises a buffer memory simultaneously performing read-out operation and write-in operation, and wherein the read-out operation of the write buffer memory unit is faster than the write-in operation of the write buffer memory unit, and the write-in operation of the read buffer memory unit is faster than the read-out operation of the read buffer memory.

2. The liquid crystal display of claim 1, wherein the modifier further comprises a controller controlling operations of the buffer memory unit and the frame memory.

3. The liquid crystal display of claim 1, wherein the frame memory has a single input/output port.

4. The liquid crystal display of claim 3, wherein access speed to the frame memory is equal to or higher than transmission speed of the gray signals to the buffer memory unit and to the converter.

5. The liquid crystal display of claim 3, wherein the access speed to the frame memory is at least twice as high as the transmission speed of the gray signals to the buffer memory unit and to the converter.

6. A liquid crystal display comprising:

a liquid crystal panel assembly including a plurality of pixels;

a gray signal modifier generating modified gray signals for gray signals from an external source, the modifier including a memory unit storing data segments of the gray signals and a gray signal converter converting the gray signals into the modified gray signals based on the data segments from the memory unit; and a data driver converting the modified gray signals into corresponding image signals to provide for the pixels;

wherein the memory unit further comprises:

a single input/output port;

a frame memory storing data segments of the a current gray signal and a previous gray signal; and a buffer memory unit storing and providing data segments of the current gray signal from the external source for the frame memory and storing and providing data segments of the previous gray signal from the frame memory for the converter;

wherein the access speed to the frame memory is α times faster than transmission speed of the gray signals to the buffer memory unit and to the converter, wherein $$\alpha = \frac{2m + FML + DQM + BML + \Delta}{m},$$

where m represents size of a data segment measured by clocks, FML represents the number of clocks for delay of the frame memory, BML represents the number of clocks for delay of the buffer memory unit, Δ represents the number of clocks required for movement of a data segment from the buffer memory unit to the frame memory, and DQM represents the number of clocks required for masking between read-out and write-in operations of the frame memory in order to avoid I/O bus collision.

7. A liquid crystal display comprising:

a liquid crystal panel assembly including a plurality of pixels;

a gray signal modifier generating modified gray signals for gray signals from an external source, the modifier including a memory unit storing data segments of the gray signals and a gray signal converter converting the gray signals into the modified gray signals based on the data segments from the memory unit; and a data driver converting the modified gray signals into corresponding image signals to provide for the pixels;

wherein the memory unit further comprises:

a single input/output port;

a frame memory storing data segments of the a current gray signal and a previous gray signal; and a buffer memory unit storing and providing data segments of the current gray signal from the external source for the frame memory and storing and providing data segments of the previous gray signal from the frame memory for the converter;

wherein the access speed to the frame memory is $\alpha$ times faster than transmission speed of the gray signals to the buffer memory unit and to the converter, wherein $$\alpha = \frac{2m + FML + DQM + BML + \Delta}{m + k \cdot \frac{m}{L}},$$

where m represents size of a data segment measured by clocks, FML represents the number of clocks for delay of the frame memory, BML represents the number of clocks for delay of the buffer memory unit, $\Delta$ represents the number of clocks required for movement of a data segment from the buffer memory unit to the frame memory, DQM represents the number of clocks required for masking between read-out and write-in operations of the frame memory in order to avoid I/O bus collision, k represents the number of clocks of blank section, and L represents the number of pixels in one pixel row.

8. The liquid crystal display of claim 1, wherein at least one of the write buffer memory unit and the read buffer memory unit is capable of storing a data segment.

9. The liquid crystal display of claim 1, wherein at least one of the write buffer memory unit and the read buffer memory unit is capable of storing data larger than a data segment.

10. The liquid crystal display of claim 1, wherein the write-in operation of the write buffer memory unit begins prior to beginning of the read-out operation of the write buffer memory unit.

11. The liquid crystal display of claim 1, wherein the write-in operation of the read buffer memory unit finishes prior to completion of the read-out operation of the read buffer memory unit.

12. The liquid crystal display of claim 1, wherein at least one of the write buffer memory unit and the read buffer memory unit comprises a plurality of memory devices, each memory device having a single input/output port.

13. The liquid crystal display of claim 12, wherein the at least one of the write buffer memory unit and the read buffer memory unit is capable of storing data larger than a data segment, read-out operation and write-in operation of the at least one of the write buffer memory unit and the read buffer memory unit begin or finish separated by a distance corresponding to storage capacity of one of the memory devices.

14. The liquid crystal display of claim 1 , wherein the write buffer memory unit comprises a plurality of memory devices, each memory device having a single input/output port, and is capable of storing data larger than a data segment, and wherein when later one of the read-out operation and the write-in operation of the write buffer memory unit begins, earlier operation is performing one of the plurality of memory devices different from a first memory device where the later operation begins, and when the read-out operation moves to a second memory device, the read-out operation and the write-in operation of the write buffer memory unit are performing separated by a distance corresponding to storage capacity of one of the plurality of memory devices.

15. The liquid crystal display of claim 1, wherein the read buffer memory unit comprises a plurality of memory devices, each memory device having a single input/output port, and is capable of storing data larger than a data segment, and wherein when earlier one of the read-out operation and the write-in operation of the write buffer memory unit finishes, later operation is performing one of the plurality of memory devices different from a memory device where the earlier operation finishes, and when the write-in operation moves to a final second memory device, the read-out operation and the write-in operation of the read buffer memory unit are performing separated by a distance corresponding to storage capacity of one of the plurality of memory devices.

16. The liquid crystal display of claim 1, wherein the modifier further comprises:

a signal synthesizer synthesizing input data segments of the current gray signal to providing for the buffer memory and the converter; and a signal separator separating the data segments of the modified gray signal from the converter.

17. A method of modifying gray signals for a liquid crystal display having a plurality of pixels, the method comprising:

dividing each of a current gray signal and a previous gray signal into a plurality of data segments;

storing the data segments of the previous gray signal; and storing the data segments of the current gray signal, modifying all of the plurality of data segments of the current gray signal based on the stored data segments of the previous gray signal, the data segments of current gray signal, and a lookup table;

wherein the data segments of the current gray signal are converted into the modified gray signal to improve the response speed of liquid crystal molecules in the liquid crystal panel assembly; and wherein the storing of the data segments of the current gray signal and the storing of the data segments of the previous gray signal comprise:

writing a first data segment of the current gray signal into a buffer memory unit;

reading a second data segment of the current gray signal from the buffer memory unit to write into a frame memory;

reading a first data segment of the previous gray signal from the frame memory to write into the buffer memory unit; and reading a second data segment of the previous gray signal from the buffer memory, wherein the writing of the first data segment of the current gray signal and the reading of the second data segment of the previous gray signal is simultaneously performed, and the reading of the second data segment of the current gray signal and the reading of the first data segment of the previous gray signal is alternately performed during the writing of the first data segment of the current gray signal and the reading of the second data segment of the previous gray signal, and wherein the writing and the reading for the frame memory are faster than the writing of the first data segment of the current gray signal and the reading of the second data segment of the previous gray signal for the buffer memory unit.

18. The method of claim 17, wherein the buffer memory unit comprises four buffer memories, and the first and second data segments of the current gray signal and the first and second data segments of the previous gray signal are written into and read out of the respective buffer memories.

19. The method of claim 17, wherein the buffer memory unit comprises a pair of buffer memories, and the first data segment of the current gray signal is written into and the second data segment of the current gray signal is read out of one of the pair of buffer memories while the first data segment of the previous gray signal is written into and the second data segment of the previous gray signal is read out of the other of the pair of buffer memories.

20. The method of claim 19, wherein the first data segment of the current gray signal begins to be written into the one of the pair of buffer memories before the second data segment of the current gray signal begins to be read out of the one of the pair of buffer memories.

21. The method of claim 19, wherein the first data segment of the previous gray signal finishes to be written into the other of the pair of buffer memories before the second data segment of the previous gray signal finishes to be read out of the other of the pair of buffer memories.

* * * * *